US006027361A

United States Patent [19]

Burmeister et al.

[11] Patent Number: 6,027,361

[45] Date of Patent: Feb. 22, 2000

[54] INSULATION DISPLACEMENT CONTACT AND A TERMINAL STRIP OR MODULE AND A SERIES TERMINAL COMPRISING AT LEAST ONE INSULATION DISPLACEMENT CONTACT

[75] Inventors: Klaus-Dieter Burmeister; Norbert Gaertner; Stefan Wildner; Wolfgang Edelmann, all of Wuppertal; Hans-Dieter Otto, Wipperfürth, all of Germany

[73] Assignee: Quante AG, Wuppertal, Germany

[21] Appl. No.: 09/116,706

[22] Filed: Jul. 17, 1998

[30] Foreign Application Priority Data

Jul. 25, 1997 [DE] Germany ..... 197 32 182

[51] Int. Cl.[7] ..... H01R 4/24

[52] U.S. Cl. ..... 439/395; 439/408

[58] Field of Search ..... 439/395, 408, 439/839

[56] References Cited

U.S. PATENT DOCUMENTS

| | | | |
|---|---|---|---|
| Re. 32,898 | 4/1989 | Dechelette | 439/395 |
| 3,854,114 | 12/1974 | Kloth et al. | 439/398 |
| 3,990,762 | 11/1976 | Lemesle | 439/395 |
| 4,036,545 | 7/1977 | Mysiak et al. | 439/395 |
| 4,114,975 | 9/1978 | Weidler | 439/391 |
| 4,169,646 | 10/1979 | Stape et al. | 439/397 |
| 4,281,886 | 8/1981 | Kaplan | 439/395 |
| 4,553,808 | 11/1985 | Weidler et al. | 439/626 |
| 4,682,835 | 7/1987 | Aujla et al. | 439/395 |
| 4,773,875 | 9/1988 | Huiskes | 439/395 |
| 5,306,177 | 4/1994 | Burke et al. | 439/395 |
| 5,453,028 | 9/1995 | Grambley et al. | 439/441 |
| 5,626,488 | 5/1997 | Albeck et al. | 439/395 |

FOREIGN PATENT DOCUMENTS

| | | |
|---|---|---|
| 0 304 066 B1 | 1/1994 | European Pat. Off. . |
| 86 04 746 U | 5/1986 | Germany . |
| 87 11 376 U | 11/1987 | Germany . |
| 195 41 137A1 | 5/1997 | Germany . |

*Primary Examiner*—Paula Bradley
*Assistant Examiner*—Alexander Gilman
*Attorney, Agent, or Firm*—Finnegan, Henderson, Farabow, Garrett & Dunner, L.L.P.

[57] ABSTRACT

An insulation displacement contact (10) comprises a contact spring (12) with two resilient contact shanks (20) that limit a contact slot (30), and a U-shaped force spring (14) formed as a separate component from the contact spring (12). The shanks (28) of the force spring (14) run largely perpendicular to regions of the contact shanks (20) and encompass same.

24 Claims, 3 Drawing Sheets

INSULATION DISPLACEMENT CONTACT AND A TERMINAL STRIP OR MODULE AND A SERIES TERMINAL COMPRISING AT LEAST ONE INSULATION DISPLACEMENT CONTACT

TECHNICAL FIELD

The invention relates to an insulation displacement contact used in connection technology for joining two copper wires as well as a terminal strip or module and a series terminal comprising at least one insulation displacement contact.

Insulation displacement contacts generally serve to connect electrical conductors, which is achieved by penetrating an insulation and subsequently contacting the conductor's core wire. Particularly if the conductors or wires to be connected are comparatively thick, comparatively high forces and consequently a stable design to be exhibited by the insulation displacement contact are necessary for the aforementioned penetration and contacting of the core of the wires.

As regards a compact construction of the terminal, on the other hand, it is desirable to design the pitch, i.e. the dimension between two contacts, to be as small as possible. Whereas a stably designed and hence large contact is needed to ensure an adequate force that acts upon the conductor so as to penetrate the insulation and to contact the core wire, the insulation displacement contact has to be designed as compactly as possible in order to obtain a small pitch.

DESCRIPTION OF THE RELATED ART

Insulation displacement contacts which represent special measures for supporting the clamping action of a contact are generally known in this field. For example, utility model DE-GM 87 11 376 describes an electrical terminal whose contact slot is limited by two plates which are supported at their outer edges by bent-up side walls. This attachment is characterized, however, by a structural size which is unsuitable for use in compact connection elements.

This equally applies to the insulation displacer according to utility model DE-GM 86 04 746 which comprises two contact slots each limited by a pair of contact shanks. A reinforcing spring is provided to support the force. This produces an intricate contact design, and the use of four contact shanks for the purpose of limiting two contact slots also entails a comparatively large contact design.

A so-called front wiring terminal is disclosed in DE 195 41 137 A1 and comprises pivotable contact brackets to which a comparatively narrow reinforcing spring extending with its shanks parallel to the contact shanks can be attached in a complex manner so as to support clamping. Due to the pivotable attachment of the contact brackets, the depicted configuration is, nevertheless, complicated and due to the movable elements is also susceptible to interference.

Configurations in which a contact spring experiences a supported force as a result of a chamber within a housing accommodating the contact spring are also known in the prior art. As regards such a housing portion, however, suitable flexible resilient properties of the housing chambers can be depicted only with difficulty, and as a result it is consequently impossible to suitably design the contact spring's deformation characteristic.

SUMMARY OF THE INVENTION

In view of these drawbacks exhibited by the insulation displacement contacts known in the prior art, the invention is based upon the object of providing an insulation displacement contact which has a low structural width in the direction of pitch and at the same time ensures reliable penetration of the insulation of the connected conductors and contacting of the core wire. The insulation displacement contact is intended to function reliably and to be easily integrated into a housing. Furthermore, the invention is intended to provide a terminal strip or module as well as a series terminal comprising at least one insulation displacement contact meeting the above-mentioned requirements.

The insulation displacement contact according to the invention therefore comprises a contact spring having two resilient contact shanks which limit a contact slot. A U-shaped force spring (also known as a reinforcing spring) is provided as a separate component from the contact spring. Unlike some of the embodiments known in the prior art, the material of the contact shanks and of the force spring can as a result be ideally adapted to the particular requirements expected of these components. In particular, a material exhibiting good electrical conduction properties can be used for the contact shanks. A material exhibiting good spring properties is advantageously used for the force spring. This allows the contact to be designed compactly as a whole in that the contact shanks are designed comparatively small, which is possible because the force needed for contacting is summoned up by the separate force spring. This spring can be designed and arranged such that due to the envisaged good spring properties, it compresses the contact shanks in the direction of the contact slot in such a way as to ensure reliable functionality.

The use of a separate force spring also offers considerable advantages in terms of manufacturing the so-called contact spring which contains the two contact shanks. The contact slot between the two contact shanks can in fact be produced with comparatively approximate manufacturing tolerances as a result of punching. This—for example in contrast to separating the sheet metal by way of cutting—produces neatly formed edges. The width of the contact slot is essentially controlled by the force applied by the force spring and depends to a lesser extent on manufacturing tolerances. The force spring compresses the contact shanks out of a starting position to a certain extent, causing the contact slot to exhibit a desired width.

As a result of the fact that the force spring compresses the contact shanks to a certain extent against their spring force, a comparatively low force is needed to deform the contact shanks against the force of the force spring back into their original state, making it possible to contact thin wires without running the risk of their separation. Yet if comparatively thick wires are to be contacted, a high force is necessary for separating the equally thicker insulation; after spreading open the contact shanks beyond their original state, such a force is applied by the force spring and to a certain extent by the contact spring. The contact according to the invention therefore advantageously exhibits a specific spring characteristic and can be used for a large range of wires of thinner and thicker shapes.

According to a first embodiment of the insulation displacement contact according to the invention, the shanks of the force spring pass largely perpendicular to insulation displacement regions of the contact shanks and encompass same. As a result, an advantageous combination of a contact spring (formed by the contact shanks) and a separate force spring is obtained in a completely innovative way. The contact shanks and the force spring can for example be designed and arranged such that the contact edges of the contact shanks which form a contact slot remain parallel to one another even when opening the contact, e.g. when wires are connected. This is brought about by aligning the shanks of the force spring perpendicular to the direction of the contact shanks. This orientation also makes it particularly simple to connect the contact spring and force spring so as to transfer the spring forces.

As regards the aforementioned first embodiment, it is advantageous for the contact shanks to be bent in a region remote from their end. It should be noted that the contact shanks are usually integrally formed on the contact spring. They are joined together to a certain extent at a site which is remote from their ends, causing the contact slot limited by the contact shanks to terminate at this site. If a bend, preferably by about 90°, is provided in the contact according to the invention in the region between the front end of the contact shanks and their connecting site, the force spring with its shanks which run perpendicular to the contact shanks can be attached to the front regions of the contact shanks in such a way that the contact slot opens when the contact shanks are arranged in parallel.

Whereas a largely V-shaped opening of the contact shanks occurs in the case of unbent contact shanks when pressing a wire into the contact slot, a V-shaped opening is present in the above-described embodiment only as regards the region between the aforementioned bend and the connecting site of the contact shanks. If the contact shanks between the bend and their front ends run at an angle of about 90° to the aforementioned region, the contact shanks exhibit an opening movement that occurs when the two contact shanks are arranged largely in parallel.

If in accordance with the invention the force spring is also attached to this front region of the contact shanks such that its shanks run largely perpendicular to the contact shanks, good support of the contact shanks' opening movement is obtained to the extent that they separate when aligned largely in parallel. This is particularly advantageous if two conductors are to be connected simultaneously, i.e. in succession or in superposition within a contact slot. In the case of a contact that opens in a V shape, this causes the conductor located closer to the end of the contact shanks to be less substantially clamped and contacted, whereas the lower conductor runs the risk of its core wire being cut into too considerably. These drawbacks are avoided in the above embodiment of the insulation displacement contact according to the invention in that the contact slot opens largely in parallel, so that the opening of the contact slot and hence the clamping of the respective wire is largely equal for both wires.

As concerns the aforementioned embodiment, it is preferable for the U-shaped force spring to have largely plate-shaped shanks which encompass the insulation displacement regions of the contact shanks across a longer region, in other words across a certain width extending along the contact slot. In this embodiment, the contract spring's force can be supported in a particularly stable and evenly distributed manner.

A second embodiment of the invention corresponds to the first embodiment in terms of the force spring formed separately from the contact shanks. In this second embodiment, however, the shanks of the force spring run largely parallel to the contact shanks, with the contact shanks being continued between the shanks of the force spring such that they penetrate the force spring. As a result, it is possible to lend the insulation displacement contact a particularly compact design. This contact particularly comprises just two contact shanks and is fixed. The contact shanks themselves or the component on which they are formed can also be lent good electrical conduction properties.

The force necessary for reliably contacting the wires is summoned up by the separate force spring made of a material exhibiting good spring properties, with this spring being attached to the contact shanks in a space-saving manner. The shanks of the U-shaped force spring run to a certain extent directly at the outer edges of the contact shanks, whereby the shanks of the force spring can also be penetrated at least to an extent by the contact shanks. This penetration particularly exists for the force spring's base, i.e. the region between the shanks. In consequence, the U-shaped force spring, just like in the first embodiment, requires little constructional space in one direction at the side of the outer edges of the contact shanks, making it possible to use such an insulation displacement contact to achieve a low terminal pitch. The separate force spring made of a suitable material is able to make the necessary force available for reliable contacting of inserted wires.

In the insulation displacement contact according to the invention, the contact shanks and the force spring shanks are preferably connected together in a form-locked manner. This produces a simple attachment which is also suitable for applying the necessary forces when the force spring interacts with the contact spring.

A particularly simple formation of the connecting site between the force spring and the contact shanks can be brought about in the form of recessing the contact shanks on their outer edges. The force spring shanks can engage with these recesses and ensure the form-locked connection.

Particular advantages can be obtained if the force spring is able to be caught on the contact spring. Before insertion into a housing, it is as a result possible to a certain extent to form a unit which can be assembled in this state under conditions that are not restricted by the housing.

In other applications, it is preferred that the force spring and the contact spring are separate from one another (loosely arranged in relation to one another), i.e. there is not provision for their being fixedly connected together outside a housing. In this instance, the force and contact springs are positioned by a housing or a housing chamber in accordance with the function to be performed. As a result of the fact that in this embodiment it is possible to dispense with the recesses on the outer edges of the contact shanks and those regions of the force spring which interact with these recesses, the structure of the two elements is particularly simple. The necessary positional assignment is ensured by regions of the housing into which the force and contact springs are inserted.

As regards certain applications, it may be advantageous for the contact shanks to be offset and/or twisted in relation to one another with respect to a direction perpendicular to their planar extension. In this context, offset means that the two contact shanks are located at slightly spaced apart sites along the length of an inserted wire. Twisting is to be defined as the fact that the respective sheet-metal surfaces of the contact shanks are not located on a common plane. On the contrary, the twist causes them to be at an angle to one another. The two contact shanks can optionally be both offset and twisted in relation to one another.

As regards the insertion of wires, it may be particularly advantageous when using stranded wires for these wires to be funnel-shaped and "soft", i.e. designed in the shape of a guiding hopper which does not have any cutting edges. Rather, the cutting edges that serve to separate the insulation are not formed until the further course of the contact shanks.

This largely prevents the outer stranded conductors from being damaged or disconnected.

As far as other applications are concerned, it is preferred that the contact shanks have an insertion opening provided with cutting edges. These are so-called pre-cutting edges which do not serve to contact the core wire, but to an extent tear the insulation right during the insertion of the wires. When using corresponding wires, advantages can as a result be obtained in terms of the reliability exhibited by the penetration of the insulation and by the contacting of the core wire.

It should also be noted that all the aforementioned features of preferred embodiments of the invention can be combined in order to make use of the respective benefits when they are combined.

Finally, the present invention is used to present a terminal strip, a terminal module and a series terminal (also known as a connection/disconnection strip, connection/disconnection module and a terminal block respectively) which each comprise at least one insulation displacement contact according to one of the aforementioned preferred embodiments.

BRIEF DESCRIPTION OF THE DRAWINGS

The invention will be explained in further detail as follows by means of the embodiments depicted by way of example in the drawings.

DETAILED DESCRIPTION OF PREFERRED EMBODIMENTS OF THE INVENTION

Figure 1:
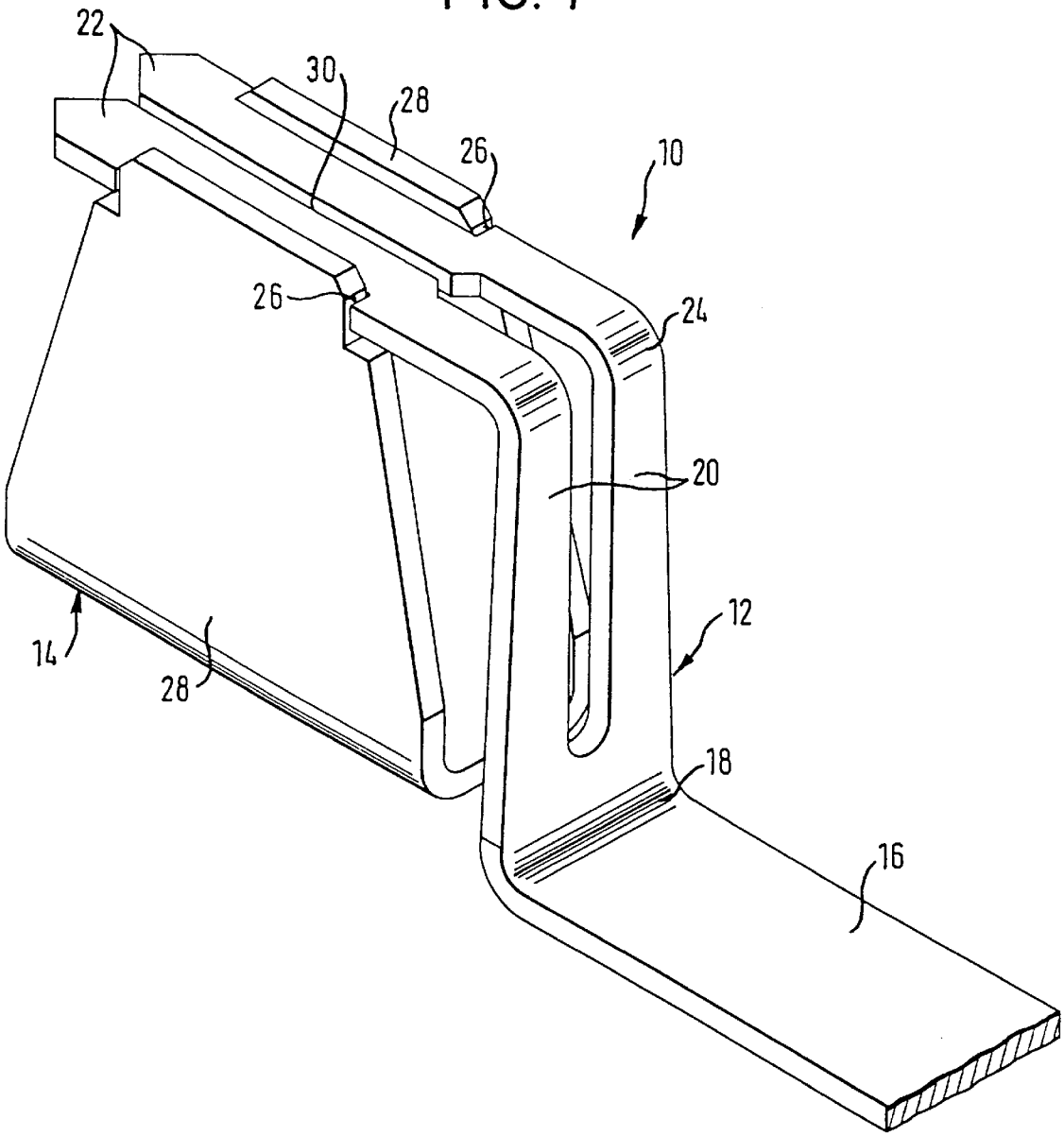
FIG. 1 shows a perspective view of a first embodiment of an insulation displacement contact according to the invention.

As shown in FIG. 1, the contact 10 according to the invention comprises a so-called contact spring 12 on the one side and a force spring 14 separate therefrom on the other. In the example depicted, two contact shanks 20 largely parallel to one another extend from a base portion 16 of the contact spring 12 in front of a first bend 18. These two contact shanks 20 are again bent in their course as far as their front ends 22. In the region between the second bend 24 and the front end 22, the two contact shanks 20 are encompassed at the sides by the U-shaped force spring 14. To create a form-locked connection between the contact shanks 20 and the force spring 14, the two contact shanks 20 each have on their outer edge a recess 26 into which the offset ends of the two shanks 28 of the force spring 14 are inserted. This produces a form-locked connection between the force spring 14 and the contact spring 12.

The embodiment shown in FIG. 1 represents that embodiment of the invention in which the contact shanks 20 pass largely perpendicular to the shanks 28 of the force spring 14. As is apparent from the Figure, those regions of the contact shanks 20 that are located between the bend 24 and the front end 22 are aligned to be largely horizontal. In contrast, the shanks 28 of the force spring 24 extend largely vertically. When inserting a wire into the contact slot 30 at the front ends 22 of the contact shanks 20, a force is exerted upon the two contact shanks 20 which spreads these shanks outwards. This spreading has to take place against the spring force of the contact shanks 28 which presses the contact shanks 20 together. Due to the fact that the contact shanks 28 make contact with the outsides of the contact shanks 20 across a certain width, viz. in the region of the extension of the respective recess 26, and due to the fact that the contact shanks 20 are bent at the site 24, the contact shanks also remain largely parallel to one another in the spread state.

If the contact shanks 20 were in fact joined together in the region of the site 24, they would endeavor to open in a V-shape (as seen in the top view). In the depicted embodiment, however, such a V-shaped opening occurs with regard to the contact shanks 20 only in the region between the bend 24 and the site in proximity to the second bend 18 at which the contact slot terminates, and the two contact shanks 20 merge into the common base portion 16.

Those regions of the contact shanks 20 that are located between the bend 24 and the front end 22 remain largely parallel to one another and when opening move essentially as far apart as this is the case for the respective site 24 on the contact shank 20. This applies, to a largely equal extent, to the region along the contact shanks 20 between the bend 24 and the front end 22. As a result of the fact that the external force is applied by the force spring 14 to the outer edges of the contact shanks in this region, the parallel alignment of the two contact shanks 20 in this region is further assisted in relation to one another, making it possible to insert two wires easily without entailing a different opening width for the successively inserted wires, as would be the case if there were a conventional V-shaped opening.

It should also be noted that the force spring 14 including its shanks 28 has a certain longitudinal extension so as to form shanks 28 and a connecting piece between the shanks which are largely plate-like. As mentioned, a broadly distributed application of the externally supported force to the two contact shanks 20 can be ensured as a result. FIG. 1 also shows that the ends 22 of the contact shanks 20 as an insertion opening for the contact slot 30 are at an angle, thus enabling wires to be inserted gently and smoothly.

Finally, the contact slot has a narrow region between the end 22 and the bend 24 and has a broader region between the bends 24 and 18.

Figure 2:
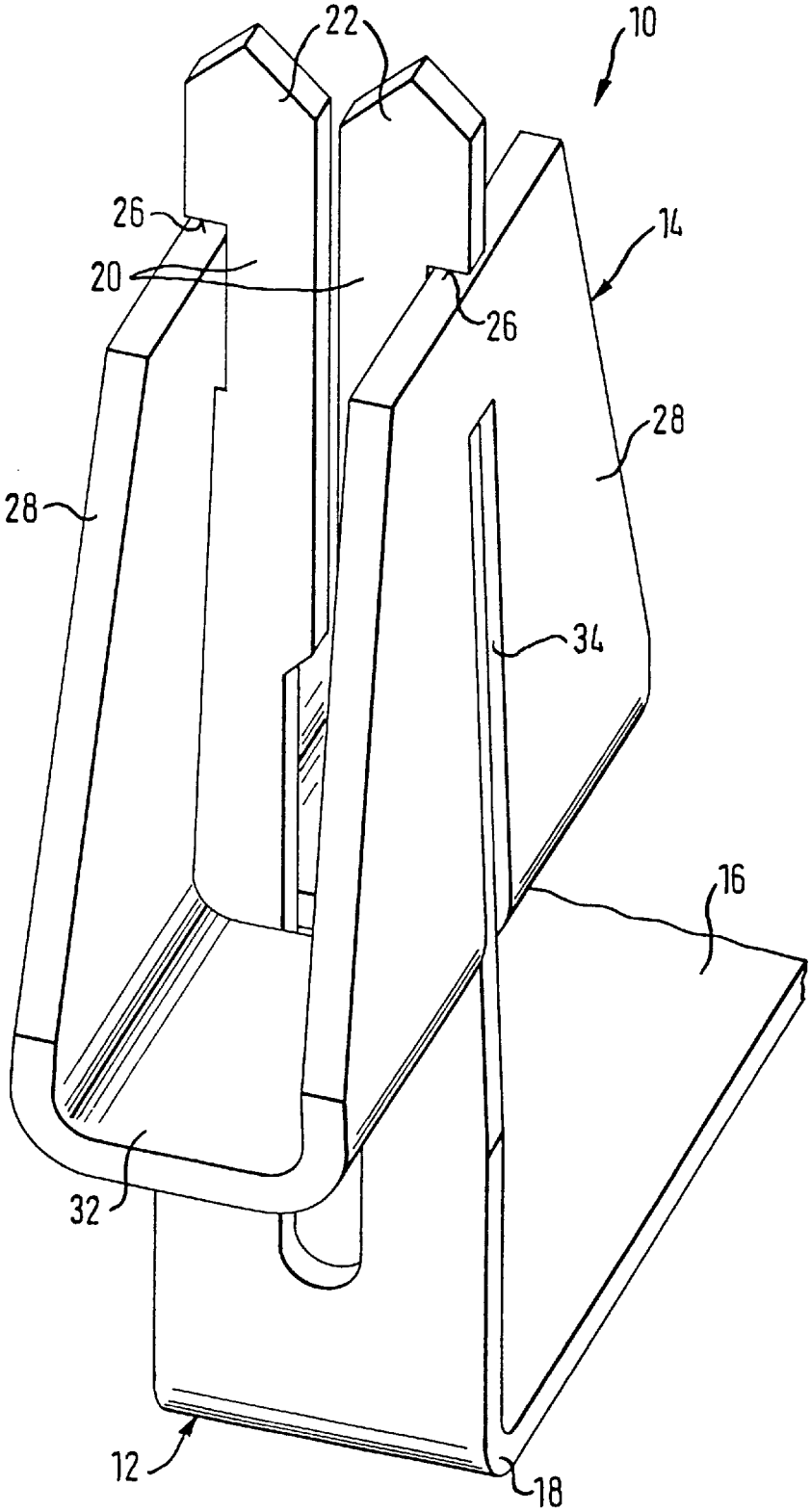
FIG. 2 shows a perspective view of an insulation displacement contact according to the invention in a second embodiment.

FIG. 2 depicts a second embodiment of the insulation displacement contact 10 according to the invention. In accordance with the invention, the contact 10 according to FIG. 2 also has a contact spring 12 which is encompassed to a certain extent by a separately formed force spring 14. In terms of the contact slot and the front ends 22 of the two contact shanks 20, the contact spring 12 is similar in design to the contact spring 12, except that the contact shanks 20 are not bent. Rather, just a single bend 18 is located between a base portion 16 and the contact shanks 20 on the contact spring 12.

According to the invention, the contact spring 12 is advantageously made from a material that exhibits good electrical conduction and which does not necessarily have good spring properties. To apply the necessary clamping and contacting force to inserted wires, the contact shanks 20 are externally encompassed by the separate force spring 14 made of a material exhibiting good spring properties. In the embodiment of FIG. 2, the force spring 14 is also designed with a certain longitudinal extension so that both the shanks 28 and the connection 32 between the two shanks 28 are plate-like.

In the embodiment shown in FIG. 2, this connection region 32 between the two shanks 28 is penetrated by the contact shanks 20. As a result, the force spring 14 can be disposed and attached in the region of the contact shanks 20 so as to save space, and it does not interfere in any way with the design of the base portion 16. In the embodiment shown, suitable recesses 34, through which the contact shanks 20 extend in the region of their outer edges, are also formed in the region of the two shanks 28 of the force spring 14.

The slots 34 do, however, end a certain distance before the upper edge of the force spring 14, thus forming continuous surfaces in the end regions of the contact shanks 28; by means of these surfaces, the two contact shanks 28 in recesses 26 of the contact shanks 20 are connected to same. The illustrated force spring 14 can in particular be caught on the contact spring 12 as a result of inserting the contact shanks 20 through the connecting piece 32 in the force spring 14 and by pushing down the force spring 14. This produces an insulation displacement contact unit which can be assembled and handled before installation into a housing.

As an alternative, it is also conceivable for the two components to be connected by the housing without the measures necessary for locking or catching at the contacts (recess 26) and force spring (corresponding surfaces). In other words, the components are individually inserted into the housing or housing parts, and the necessary positional assignment occurs when assembling the housing. A housing into which the insulation displacement contacts are to be inserted also comprises a slide into which the wires can be inserted, causing them to be pressed into the respective contact slots 30 when the slide is pressed down.

It must also be noted in relation to the embodiment in FIG. 2 that the contact shanks 20 and the shanks 28 of the force spring 14 extend largely parallel to one another, which is advantageous in certain applications. The compact attachment of the force spring 14 to the contact spring 12 also ensures a minimum constructional size, and the force applied to an inserted wire can be advantageously controlled by the external force spring 14.

Figure 3:
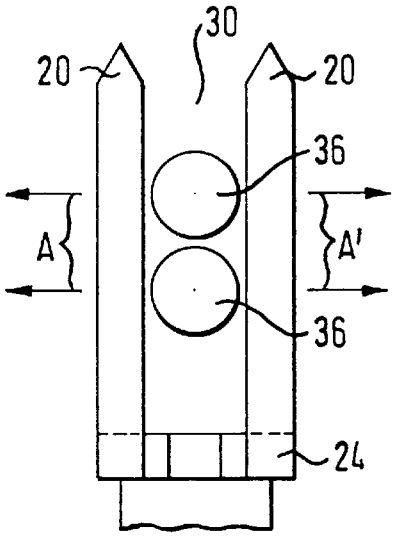
FIG. 3 shows a schematic top view of the embodiment shown in FIG. 1.

FIG. 3 additionally shows how in the embodiment depicted in FIG. 1, the contact slot 30 opens when the two contact shanks 20 have a parallel configuration. The schematic top view shows that those regions of the contact shanks 20 which pass between the bend 18 in FIG. 1 and the second bend 24 and extend largely perpendicular to the plane of projection according to FIG. 3 open in a V-shape. The regions of the contact shanks 20 in front of the bend 24 follow the movement of the respective sites 24, causing them—supported by the force spring 14—to remain parallel to one another. The contact shanks 20 therefore move apart in a largely parallel alignment to one another in the direction of arrow A or A', with the result that for two successively inserted wires 36, there is one contact slot 30 which is largely of identical size.

Figure 4:
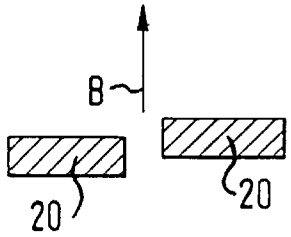
FIG. 4 shows a schematic cross-sectional view of contact shanks offset in relation to one another.

FIG. 4 schematically shows a preferred layout of the two contact shanks 20 in relation to one another. It can be identified in the cross-sectional view that the two contact shanks 20 relative to a direction B, in which an inserted wire runs, are offset in relation to one another. As a result, beneficial contacting properties can be achieved in certain applications.

Figure 5:
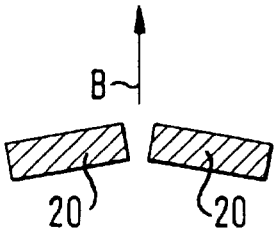
FIG. 5 shows a schematic cross-sectional view of contact shanks twisted in relation to one another.
Figure 6:
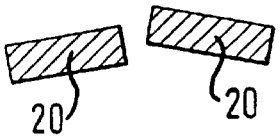
FIG. 6 a schematic cross-sectional view of contact shanks offset and twisted in relation to one another.

In FIG. 5, the two contact shanks are twisted in relation to one another, i.e. they do not form with their planar extension an exact right angle to the direction of progression B of an inserted wire, but are slightly twisted with respect to this alignment. As a result, beneficial contacting action can also be achieved. According to FIG. 6, the two aforementioned measures can be combined; the two contact shanks 20 are in fact not only offset but also twisted in relation to one another. According to the invention, in combination with a separate, external force spring, reliable contacting of inserted wires can also be achieved by means of this embodiment, while entailing comparatively little constructional space.

What is claimed:

1. An insulation displacement contact comprising:

a contact spring having two resilient contact shanks delimiting a contact slot, and a U-shaped force spring formed as a separate component from said contact spring shanks running generally perpendicular to insulation displacement regions of and encompassing said contact shanks to oppose opening of the contact slot.

2. An insulation displacement contact according to claim 1, wherein said contact shanks and said spring shanks of said force spring are joined by a form-locked connection.

3. A terminal strip or module comprising at least one insulation displacement contact according to claim 1.

4. A series terminal comprising at least one insulation displacement contact according to claim 1.

5. An insulation displacement contact according to claim 1, wherein said force spring and said contact spring are positioned separately from one another by a housing or housing chamber in accordance with the function to be performed.

6. An insulation displacement contact according to claim 5, wherein said contact shanks and said spring shanks of said force spring are joined by a form-locked connection.

7. An insulation displacement contact according to claim 1, wherein the spring shanks of said U-shaped force spring are of generally platelike configuration and encompass said contact shanks across an elongated region.

8. An insulation displacement contact according to claim 7, wherein said contact shanks and said spring shanks of said force spring are joined by a form-locked connection.

9. An insulation displacement contact according to claim 7, wherein said force spring and said contact spring are positioned separately from one another by a housing or housing chamber in accordance with the function to be performed.

10. An insulation displacement contact according to claim 9, wherein said contact shanks and said spring shanks of said force spring are joined by a form-locked connection.

11. An insulation displacement contact according to claim 1, wherein said contact shanks have front ends and are bent in a region remote from the front ends such that they run generally parallel to one another under a bias of said force spring even when said contact slot opens.

12. An insulation displacement contact according to claim 11, wherein said contact shanks and said spring shanks of said force spring are joined by a form-locked connection.

13. An insulation displacement contact according to claim 11, wherein the spring shanks of said U-shaped force spring are of generally plate-like configuration and encompass said contact shanks across an elongated region.

14. An insulation displacement contact according to claim 13, wherein said contact shanks and said spring shanks of said force spring are joined by a form-locked connection.

15. An insulation displacement contact according to claim 11, wherein said force spring and said contact spring are positioned separately from one another by a housing or housing chamber in accordance with the function to be performed.

16. An insulation displacement contact according to claim 15, wherein said contact shanks and said spring shanks of said force spring are joined by a form-locked connection.

17. An insulation displacement contact according to claim 13, wherein said force spring and said contact spring are positioned separately from one another by a housing or housing chamber in accordance with the function to be performed.

18. An insulation displacement contact according to claim 17, wherein said contact shanks and said spring shanks of said force spring are joined by a form-locked connection.

19. An insulation displacement contact comprising:

a contact spring having two resilient contact shanks delimiting a contact slot, and a U-shaped force spring formed as a separate component from said contact spring and having spring shanks generally parallel to said contact shanks penetrating said force spring at least in a region between said spring shanks of said force spring so that opening of the contact slot is opposed by said force spring.

20. An insulation displacement contact according to claim 19, wherein said contact shanks and said spring shanks of said force spring are joined by a form-locked connection.

21. A terminal strip or module comprising at least one insulation displacement contact according to claim 19.

22. A series terminal comprising at least one insulation displacement contact according to claim 19.

23. An insulation displacement contact according to claim 19, wherein said force spring and said contact spring are positioned separately from one another by a housing or housing chamber in accordance with the function to be performed.

24. An insulation displacement contact according to claim 23, wherein said contact shanks and said spring shanks of said force spring are joined by a form-locked connection.

* * * * *